US006050131A

United States Patent [19]

Willauer

[11] Patent Number: 6,050,131

[45] Date of Patent: Apr. 18, 2000

[54] METHOD FOR VERIFYING POSITIVE INFLATION OF AN INFLATABLE ELEMENT

[75] Inventor: Darrin L. Willauer, The Woodlands, Tex.

[73] Assignee: Baker Hughes Incorporated, Houston, Tex.

[21] Appl. No.: 08/920,060

[22] Filed: Aug. 26, 1997

Related U.S. Application Data

[60] Provisional application No. 60/026,082, Aug. 26, 1996.

[51] Int. Cl.[7] ..... E21B 33/127; H01H 39/00; B60R 21/20; E16J 15/46

[52] U.S. Cl. ..... 73/37; 73/49.8; 166/250.01; 166/250.17; 200/61.42; 340/856.2

[58] Field of Search ..... 73/37, 49.8, 48, 73/40; 340/853.3, 856.2; 166/250.01, 250.04, 66, 101, 118, 120, 250.17; 200/61.08, 61.4, 61.42, 506, 511

[56] References Cited

U.S. PATENT DOCUMENTS

| | | | |
|---|---|---|---|
| 3,387,488 | 6/1968 | Walker | 73/49 |
| 3,751,618 | 8/1973 | Hallerberg | 200/159 R |
| 3,953,690 | 4/1976 | Korr et al. | 200/61.08 |
| 3,972,442 | 8/1976 | Malcolm | 220/89 A |
| 3,979,570 | 9/1976 | Hyodo | 200/264 |
| 4,031,348 | 6/1977 | Eberhardt | 200/532 |
| 4,349,204 | 9/1982 | Malone | 277/34 |
| 4,423,783 | 1/1984 | Haag | 166/382 |
| 4,726,223 | 2/1988 | Huang | 73/146.8 |
| 5,023,418 | 6/1991 | Beckhausen | 200/511 |
| 5,101,908 | 4/1992 | Mody | 166/387 |
| 5,121,595 | 6/1992 | Shore | 53/79 |
| 5,196,017 | 3/1993 | Silva et al. | 604/97 |
| 5,327,346 | 7/1994 | Goodell | 701/71 |
| 5,425,713 | 6/1995 | Taylor et al. | 604/100 |
| 5,614,660 | 3/1997 | Tanaka | 73/37 |
| 5,639,118 | 6/1997 | Rhule et al. | 280/743.1 |
| 5,767,398 | 6/1998 | Naedler | 73/146.2 |

*Primary Examiner*—Hezron Williams
*Assistant Examiner*—J. David Wiggins
*Attorney, Agent, or Firm*—Cantor Colburn LLP

[57] ABSTRACT

An apparatus and method for verifying positive inflation of an inflatable element include electrical switches or sensors adapted to be actuated when sufficient element to borehole wall contact is achieved. The device may be a micro switch similar to that used in a calculator button, proximity switch or may employ a spear type arrangement wherein a spear is connected to one lead and is isolated from the other lead by insulation and wherein the spear is forced radially inwardly by the radially outwardly expansion of the cover on the element against the borehole wall. Upon piercing the insulation, the spear will have connected first and second leads that such connection being detectable via hard wire to the surface and electrical continuity whereby downhole electronics or intelligence whereby a downhole signal generator using any type of telemetry to communicate uphole. With each of the embodiments of the invention, the pressure of the element against the borehole wall may be predetermined in order to actuate the device of the invention.

26 Claims, 3 Drawing Sheets

METHOD FOR VERIFYING POSITIVE INFLATION OF AN INFLATABLE ELEMENT

CROSS-REFERENCE TO RELATED APPLICATIONS

This application claims the benefit of U.S. Provisional Application Ser. No. 60/026,082 filed Aug. 26, 1996.

BACKGROUND OF THE INVENTION

1. Field of the Invention

This invention relates to downhole tools in an oil well. More particularly, the invention relates to a method and apparatus for positively verifying complete deployment of a downhole tool.

2. Prior Art

Conventionally, information regarding the extent to which inflatable elements had been inflated by an actuation hereof was limited to pressuring up in the downhole environment either above or below the inflatable element in determining whether such pressure would be maintained. While in a perfect situation, pressuring up above or below the element does provide sufficient information as to the condition of the element, because of other perhaps unforeseen leak systems it is not always possible to reliably verify positive inflation of the element. For example, the element being considered may well have been completely positively inflated and may have provided sufficient contact with the well bore wall to function well for its intended purpose, however, if a reservoir is naturally fractured pressuring up above or below the element would likely yield a leak situation which may indicate to the surface and the drill operator that the inflatable element had not completely sealed. Moreover, there may be simply leak ways in the wellbore itself thus providing erroneous information to the surface. Leaking tube joints, fractures in the formation and channeling around the casing are all common difficulties in employing pressure above or below an element to verify seal integrity. There are also some cases in which it is impossible due to other factors to pressure the environment either above or below the seal. In such cases, positive element inflation confidence may not be due to much more than happenstance.

SUMMARY OF THE INVENTION

The above-discussed and other drawbacks and deficiencies of the prior art are overcome or alleviated by the apparatus and method for verifying seal integrity of the invention.

In the concept of the invention, the limitations of prior art seal integrity measures have been eliminated by providing direct measurement of the seals as opposed to an indirect gleaming of information from a cause and effect relationship. The present invention embeds an electrical or electromechanical sensor or button in the outer covering of the inflatable element in a position such that when the element is inflated the electrical or electromechanical device will be urged into contact with the wellbore wall whereby creating a signal which would be readable by a downhole device or at the surface via any conventional telemetry system. Any of these devices may signal the stopping or continuation of flow into the inflatable element from a downhole condition and position or may simply sense the position of the inflatable element and relay that information to the surface for a decision as to whether additional pressure on the fluid medium filling the element should be provided to further inflate the element.

Multiple devices of the invention may be placed anywhere on the surface of the inflatable element where that surface contacts another fixed position structure. The benefit of multiple devices is that full contact of the seal with the wall of the wellbore can be verified in any position on that element including around the entirety of the circumference thereof. Circumferential sealing verified completely suggests an excellent seal to support tools of the zone isolation or other important downhole environment regulating apparati.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
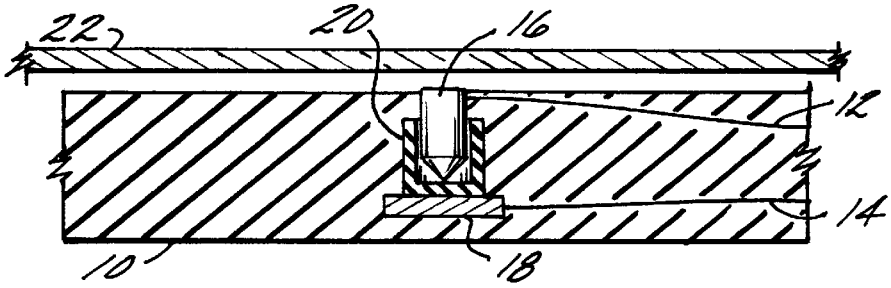
FIG. 1 is an elevational cross-section view of a packet having the pinned guide and insulator embodiment of the invention illustrated in the unactuated position.
Figure 2:
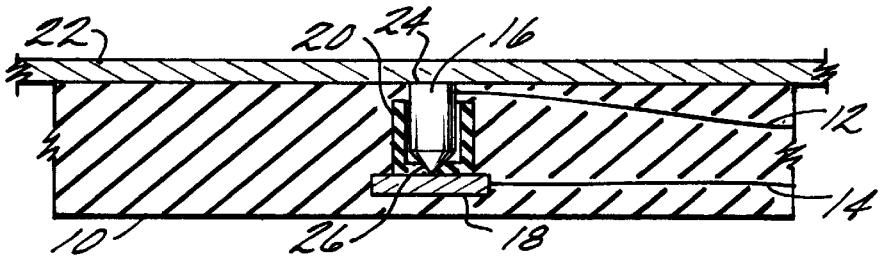
FIG. 2 is a view of FIG. 1 with a pin in the actuated position.

Referring to FIG. 1 of the present invention, a piercing pin type connection is utilized to provide inflation verification of the inflatable element. All inflatable elements typically used in the oil drilling industry are contemplated by the present invention. Since those of ordinary skill in the art readily recognize the term inflatable elements and the industry definition thereof, further explanation of the precise tools is not necessary. Therefore, the illustrations set forth herein merely indicate a section of the outer covering of a packer as an example. The broken away section of the inflatable element is indicated by numeral 10. To improve clarity of the disclosure, the cover 10 is the outer rubber covering of the exemplary packer. Embedded in cover 10 are leads 12 and 14 which are connected respectively to pin 16 and plate 18. A pin guide insulator structure 20 is provided to ensure the desired movement of the pin 16 and to electrically isolate pin 16 from plate 18. In the electrically isolated position this indicates that the inflatable element has not yet contacted wellbore wall 22 and, thus, further inflation of the inflatable element is required. Referring to FIG. 2, one of skill in the art will recognize that pin 16 has contacted wall 22 at pin contact area 24 which has forced tip 26 of pin 16 through insulator 20 and into electrical contact with plate 18. Electrical connection has, therefore, been created between lead 12 and lead 14 which will send an appropriate signal to either a downhole intelligence device or other downhole device to indicate the stop of fluid flow into the inflatable element or will send a signal to the surface via conventional telemetry (not shown). It should be appreciated that the ease of penetration of pin 16 through insulator 20 can be controlled by the degree to which point 26 is sharpened and the material properties of insulator 20. This is advantageous since this allows the tool building to regulate the amount of contact pressure between cover 10 and wall 22 to ensure the desired amount of seal pressure. By carefully choosing the parameters of point 26 sharpness and insulator 20 material properties, one can accurately determine the amount of contact pressure between cover 10 and wall 22 prior to pin 16 penetrating insulator 20 and signaling a positive inflation situation.

Figure 3:
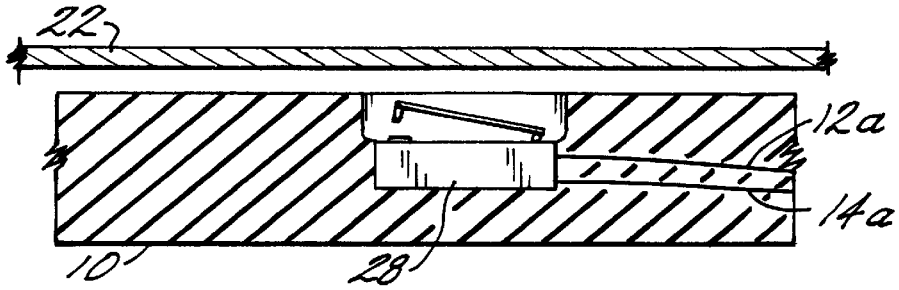
FIG. 3 is an alternate embodiment of the device of the invention wherein a micro switch is embedded in the cover of the inflatable element.

Referring now to FIG. 3, one of skill in the art will recognize that the pin and plate embodiment has been replaced by a micro switch. This allows a predetermination of the amount of pressure required to engage the switch which is therefore adjustable. This, as in the first embodiment allows the well operator or tool builder to predetermine the amount of contact stress between cover 10 and wall 22 by adjusting the pressure required to signal a positive inflation condition. The micro switch 28 comprises conventional elements, including hinged beam 29 and leads 12*a* and 14*a*, that may be easily found in electronics catalogues and which are fully familiar to those of skill in the art.

Figure 4:
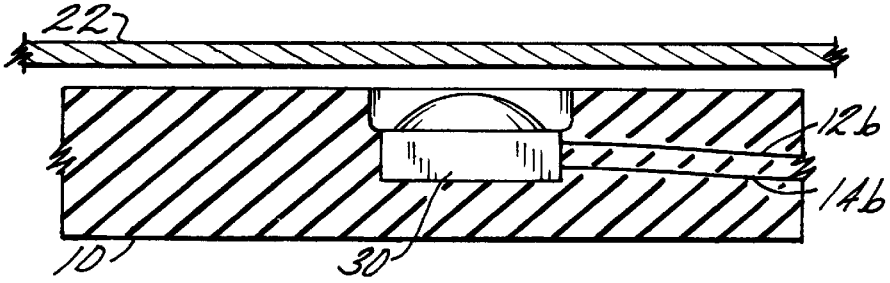
FIG. 4 is an alternate embodiment of the device of the invention wherein a membrane switch is embedded in the cover of the inflatable element.
Figure 5:
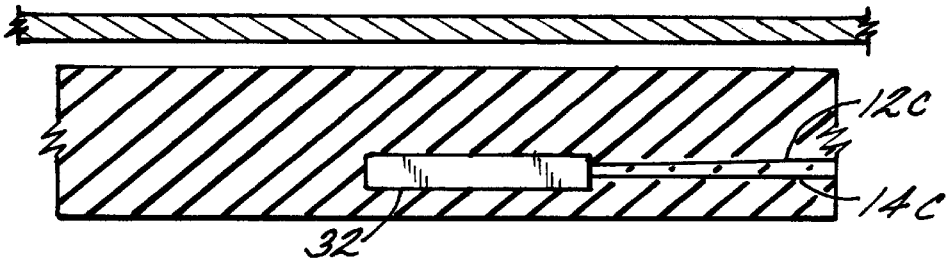
FIG. 5 an alternate embodiment of the device of the invention wherein a micro load cell is embedded in the cover of the inflatable element.

Referring to FIGS. 4 and 5, alternate embodiments of the invention are illustrated which use a membrane switch (or button switch), similar to a calculator button, 30 or a micro load cell 32. Membrane switches have a similar capability to that above in that the switch itself can be pre instructed to fire at a given strain. Thus it is possible to control the amount of stress on the wall 22 before the element stops filling. The same is true for micro load cells.

Figure 6:
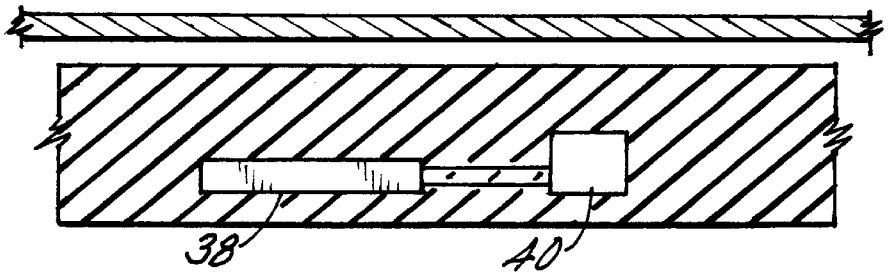
FIG. 6 is an illustration of a proximity sensor embedded in the cover of the inflatable element which will sense the wall of the borehole.
Figure 7:
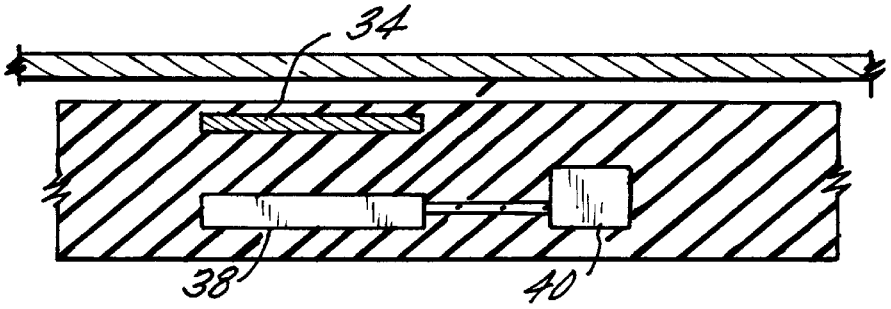
FIG. 7 is an illustration of the device of the invention where a disk is implanted in the cover of the inflatable element which disk is sensible by a positioned proximity sensor in the borehole wall.

Referring now to FIG. 6, a proximity switch embedded in cover 10 is illustrated which proximity switch 38 is constructed to be capable of sensing nearness to wall 22 at very small intervals. Alternatively this embodiment may include a metal plate 34 or disk (FIG. 7)embedded in the cover 10 at a predetermined distance from the proximity detector. The alternative arrangement is intended for use with tools being deployed in open hole situations. In general, the proximity sensor 38 will be used in connection with at least a computer circuit 40 so that the degree of proximity may be monitored and will recognize the predetermined readings before a positive inflation condition is signaled.

Where the disk embodiment is employed, the change in distance between the senor 38 and the disk is measured to determine the amount of inflation of the element. This is quantifiable because of the thinning of the cover 10 during expansion of the element. As will readily be recognized an inflatable element, as it expands, thins in a similar manner to a balloon and therefore will bring the disk and the sensor closer together.

Figure 8:
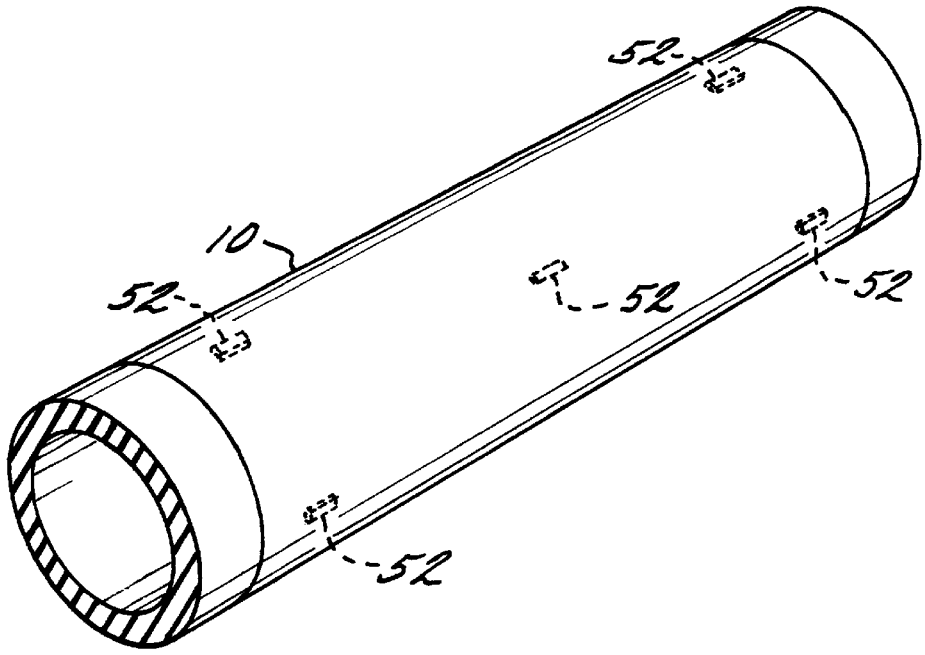
FIG. 8 illustrates a multiple verification sensing arrangement wherein a plurality of the above described figure embodiments are employed.

FIG. 8 illustrates schematically a multiple switch or sensor arrangement circumferentially positioned around the inflatable element such that positive pressure may be signaled from all points along the circumference of the element. The switches or sensors are collectively termed appreciators and are indicated by 52. A lack of sealing due to an irregularity in the wellbore would then be clear to either a downhole intelligence device or an operator at the surface whereby additional pressure might be employed to further expand the inflatable element into the irregularity and provide a positive seal. This embodiment may be accomplished with any of the types of switches described above whether all the same or different.

Figure 9:
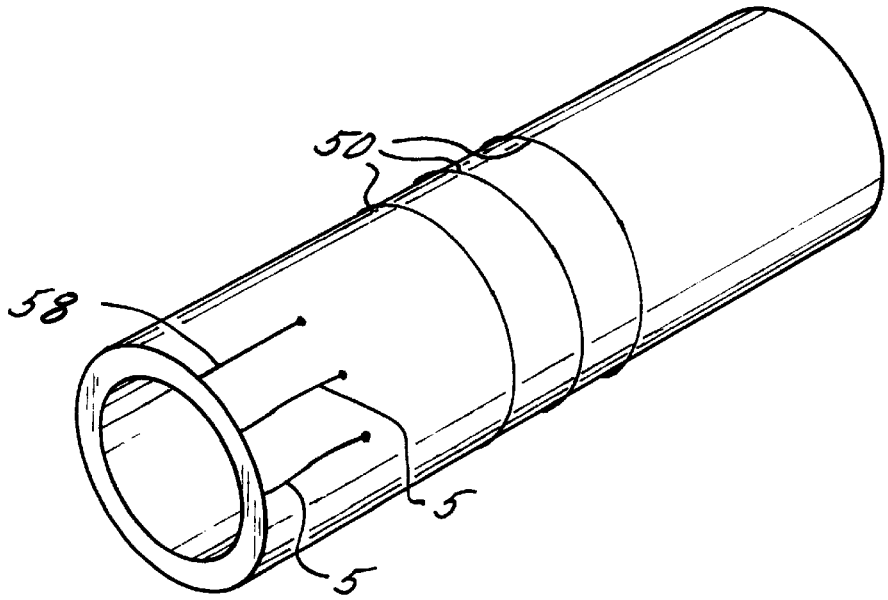
FIG. 9 is a view of an alternative embodiment of the invention wherein thin wires wrap around the circumference of the inflatable element.

In yet another embodiment of the invention, (FIG. 9) a series of wires 50 are wrapped around the inflatable element, such wires having differing lengths so as to break due to stretching at different expansion amounts of the element. By employing continuity testing an accurate determination of the condition of the wires can be obtained and therefore an accurate determination of the expansion of the element. In an alternate embodiment, still referring to this figure, the wires 58 can be run axially and still will break due to elongation of the packer. The information gathered therefore is equivalent.

As will be understood by one of skill in the art, each of the devices of the invention may be connected to a hard wire to the surface, to downhole electronic which themselves are programmed to control inflation within that environment or which are programmed to signal such condition to the surface via hard wire or by employing conventional downhole telemetry techniques.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A downhole device for verifying positive inflation of an inflatable element in a borehole comprising:

a) an inflatable element having an expandable outer surface for establishing a seal against the walls of said borehole;

b) at least one proximity appreciator located adjacent said outer surface, said at least one proximity appreciator functioning to indicate a predetermined inflated condition of said inflatable element corresponding to a desired sealing or proper setting within the borehole.

2. A downhole device for verifying positive inflation of an inflatable element in a borehole as claimed in claim 1 wherein said at least one proximity appreciator includes a pin electrically connected to a first lead and a plate electrically connected to a second lead and an insulator electrically isolating said pin from said plate, said isolator being pierceable by said pin upon said pin being urged against a predetermined structure such that electrical continuity is achieved between said pin and said plate.

3. A downhole device for verifying positive inflation of an inflatable element in a borehole as claimed in claim 2 wherein said pin insulator and plate are embedded in an outer covering of said inflatable element.

4. A downhole device for verifying positive inflation of an inflatable element in a borehole as claimed in claim 1 wherein said at least one proximity appreciator is a micro switch.

5. A downhole device for verifying positive inflation of an inflatable element in a borehole as claimed in claim 4 wherein said at least one micro switch includes a lever contact.

6. A downhole device for verifying positive inflation of an inflatable element in a borehole as claimed in claim 1 wherein said at least one proximity appreciator is a proximity sensor.

7. A downhole device for verifying positive inflation of an inflatable element in a borehole as claimed in claim 6 wherein said at least one proximity appreciator further includes a plate implanted in said cover such that said proximity sensor is capable of determining the distance between said plate and itself.

8. A manufacture for verifying positive inflation of an inflatable element in a borehole comprising:

a) an inflatable element having an expandable outer surface for establishing a seal against the walls of said borehole;

b) a plurality of proximity appreciation devices arranged perimetrically adjacent said outer surface, said plurality of proximity appreciators individually providing an indication of positive inflation pursuant to a predetermined degree of force exerted upon another structure by the inflatable element in the vicinity of the proximity appreciator, thereby ensuring attainment of a desired sealing or proper setting of said inflatable element within the borehole.

9. A manufacture for verifying positive inflation of an inflatable element in a borehole comprising:

a) an inflatable element having an expandable outer surface for establishing a seal against the walls of said borehole;

b) a multiplicity of proximity appreciation devices arranged perimetrically adjacent said outer surface said multiplicity of proximity appreciators individually providing an indication of positive inflation pursuant to a predetermined degree of force exerted upon another structure by the inflatable element, thereby ensuring attainment of a desired sealing or proper setting of said inflatable element within the borehole.

10. A downhole device for verifying positive inflation of an inflatable element in a borehole as claimed in claim 1 wherein said at least one proximity appreciator is constructed to respond only to a predetermined degree of pressure against another structure against which said inflatable element is inflated.

11. A downhole device for verifying positive inflation of an inflatable element in a borehole as claimed in claim 1 wherein said at least one proximity appreciator is a membrane switch.

12. A downhole device for verifying positive inflation of an inflatable element in a borehole comprising:

a) an inflatable element having an elastic outer covering;

b) at least one wire arranged circumferentially around the element, said at least one wire being severable due to expansion of the element;

c) a continuity device connected to said at least one wire and a controller such that when said at least one wire is severed, said controller stops the inflating of said element.

13. A downhole device for verifying positive inflation of an inflatable element in a borehole comprising:

a) an inflatable element having an elastic outer covering;

b) at least one wire arranged longitudinally with the element, said at least one wire being severable due to expansion of the element;

c) a continuity device connected to said at least one wire and a controller such that when said at least one wire is severed, said controller stops the inflating of said element.

14. A downhole device for verifying positive inflation of an inflatable element in a borehole as claimed in claim 12 wherein the at least one wire is a multiplicity of wires.

15. A downhole device for verifying positive inflation of an inflatable element in a borehole as claimed in claim 14 wherein the at least one wire is a multiplicity of wires.

16. A downhole device for verifying positive inflation of an inflatable element in a borehole comprising:

a) an inflatable element having an expandable outer surface for establishing a seal against the walls of said borehole;

b) at least one rupturable circuit located adjacent said outer surface, said at least one rupturable circuit functioning to indicate a predetermined inflated condition of said inflatable element corresponding to a desired sealing or proper setting within the borehole.

17. A downhole device for verifying positive inflation of an inflatable element in a borehole comprising:

a) an inflatable element having an expandable outer surface for establishing a sesl against the walls of said borehole;

b) at least one connectable circuit located adjacent said outer surface, said at least one connectable circuit functioning to indicate a predetermined inflated condition of said inflatable element corresponding to a desired sealing or proper setting within the borehole.

18. A method for verifying positive inflation of an inflatable element in a borehole including the steps of:

a) providing a proximity appreciator adjacent a expandable cover of an inflatable element;

b) inflating said element to establish a seal against the walls of said borehole;

c) providing a command station reactable to said proximity appreciator, to indicate a predetermined extent of inflation of the inflatable element corresponding to a desired sealing or proper setting within the borehole.

19. A method for verifying positive inflation of an inflatable element in a borehole as claimed in claim 18 wherein said command station is a downhole intelligence apparatus.

20. A method for verifying positive inflation of an inflatable element in a borehole as claimed in claim 18 wherein said command station is a surface apparatus.

21. A method for verifying positive inflation of an inflatable element in a borehole including the steps of:

a) providing at least one rupturable circuit adjacent a expandable cover of an inflatable element;

b) inflating said element to establish a seal against the walls of said borehole;

c) providing a command station reactable to said rupturable circuit, to indicate a predetermined extent of inflation of the inflatable element corresponding to a desired sealing or proper setting within the borehole.

22. A method for verifying positive inflation of an inflatable element in a borehole as claimed in claim 21 wherein said command station is a downhole intelligence apparatus.

23. A method for verifying positive inflation of an inflatable element in a borehole as claimed in claim 21 wherein said command station is a surface apparatus.

24. A method for verifying positive inflation of an inflatable element in a borehole including the steps of:

a) providing at least one connectable circuit adjacent a expandable cover of an inflatable element;

b) inflating said element to establish a seal against the walls of said borehole;

c) providing a command station reactable to said at least one connectable circuit, to indicate a predetermined extent of inflation of the inflatable element corresponding to a desired sealing or proper setting within the borehole.

25. A method for verifying positive inflation of an inflatable element in a borehole as claimed in claim 24 wherein said command station is a downhole intelligence apparatus.

26. A method for verifying positive inflation of an inflatable element in a borehole as claimed in claim 24 wherein said command station is a surface apparatus.

* * * * *